US006959979B2

(12) United States Patent
Goin et al.

(10) Patent No.: US 6,959,979 B2
(45) Date of Patent: Nov. 1, 2005

(54) MULTIPLE DROP-VOLUME PRINTHEAD APPARATUS AND METHOD

(75) Inventors: Richard L. Goin, Lexington, KY (US); James H. Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 21 days.

(21) Appl. No.: 10/750,257

(22) Filed: Dec. 31, 2003

(65) Prior Publication Data

US 2005/0146556 A1 Jul. 7, 2005

(51) Int. Cl.[7] ..... B41J 2/145; B41J 2/05
(52) U.S. Cl. ..... 347/40; 347/65
(58) Field of Search ..... 347/12, 65, 40, 347/43, 85, 86, 87

(56) References Cited

U.S. PATENT DOCUMENTS 4,680,859 A 7/1987 Johnson
4,746,935 A 5/1988 Allen
5,208,605 A 5/1993 Drake
5,519,423 A 5/1996 Moritz, III et al.
5,521,622 A 5/1996 Hock et al.
5,790,152 A 8/1998 Harrington
5,940,096 A 8/1999 Komplin et al.
6,010,208 A 1/2000 Powers et al.
6,042,222 A 3/2000 Moritz, III et al.
6,409,318 B1 6/2002 Clark
6,431,682 B1 * 8/2002 Osada et al. ..... 347/47
6,457,796 B1 * 10/2002 Fujii ..... 347/12
6,513,896 B1 2/2003 Kawamura

* cited by examiner

*Primary Examiner*—Lamson Nguyen
(74) *Attorney, Agent, or Firm*—Michael Best & Friedrich LLP

(57) ABSTRACT

Flow features in an inkjet printhead. The flow features can include a plurality of first channels, each of the plurality of first channels having a first length and positioned to fluidly communicate with an ink reservoir, and each of the plurality of first channels terminating in a first nozzle. The flow features can further include a plurality of second channels, each of the plurality of second channels having a second length greater than the first length and positioned to fluidly communicate with the ink reservoir, each of the plurality of second channels terminating in a second nozzle, each second nozzle being larger than each first nozzle.

37 Claims, 2 Drawing Sheets

MULTIPLE DROP-VOLUME PRINTHEAD APPARATUS AND METHOD

BACKGROUND OF THE INVENTION

Inkjet printheads typically include an ink reservoir in fluid communication with channels that extend to chambers and terminate in nozzles. During printing, drops of ink are ejected from the nozzles onto a printing medium. Smaller drops of ink can be used to produce high-resolution, high-quality prints with little grain. Larger drops of ink can be used to quickly fill high density areas where fine detail is not necessary. One approach to satisfying both of these needs is to produce multiple drop-volumes using the same printhead. In existing systems, nozzles capable of producing varying drop-volumes are arranged at varying distances from an ink reservoir, specifically, "near nozzles" can be positioned at a "near position," and "far nozzles" can be positioned at a "far position."

SUMMARY OF THE INVENTION

Near nozzles will typically refill at a faster rate than far nozzles at least partly because of the proximity to the ink reservoir. Channels leading to the near nozzles can be narrowed to damp the amplitude of the ink waves during refill and create a steadier flow of ink. Specifically, the narrowed channels leading to the near position can control meniscus oscillation of the near nozzles and therefore limit flooding of ink from those nozzles, while still refilling at a competitive refill rate. However, in order to ensure that the far nozzles are maintaining the competitive refill rate, the channels leading to the far nozzles are typically not as narrow as the channels leading to the near nozzles, and the ink waves are dampened to a lesser degree. As a result, the meniscus oscillations at the far nozzles are not as controlled, and overshooting, puddling or flooding of ink from the far nozzles can occur.

Larger nozzles typically take more time to refill, and as a result, have a lower refill rate. In order to balance the differences in refill rate between the smaller and larger nozzles in a printhead and ensure similar firing frequencies between all of the nozzles of a printhead, smaller nozzles (i.e., nozzles that produce smaller drops of ink) are typically positioned at the far position, and larger nozzles (i.e., nozzles that produce larger drops of ink) are typically positioned at the near position. By positioning the smaller nozzles at the far position, the refill rates of the smaller nozzles can be made to be approximately similar to that of the larger nozzles. However, smaller nozzles (e.g., nozzles capable of producing a 3 nanogram ("ng") drop of ink) are more susceptible to flooding than larger nozzles (e.g., nozzles capable of producing a 10-ng drop of ink), and positioning smaller nozzles at the less-dampened position can cause flooding from the smaller nozzles and poor print quality.

In addition, smaller nozzles are typically more susceptible to clogging than larger nozzles. As mentioned above, in existing multiple drop-volume printheads, smaller nozzles are typically positioned at the far position to balance refill rates between larger and smaller nozzles. However, this arrangement allows particles larger than the smaller nozzle (i.e., particles having a dimension greater than a cross-sectional dimension of the smaller nozzle) to pass through the channel leading to the smaller nozzle, which can cause clogging of the smaller nozzle.

Furthermore, nozzle plate delamination is common with many existing printheads. Therefore, a printhead capable of producing multiple drop-volumes that improves print quality, reduces nozzle flooding, reduces nozzle clogging and minimizes nozzle plate delamination from the printhead would be desirable.

One aspect of the present invention provides flow features for an inkjet printhead. The flow features can include a plurality of first channels defined, for example, in a nozzle plate or a thick film layer, each of the plurality of first channels having a first length and positioned to fluidly communicate with an ink reservoir, and each of the plurality of first channels terminating in a first nozzle. The flow features can further include a plurality of second channels, each of the plurality of second channels having a second length greater than the first length and positioned to fluidly communicate with the ink reservoir, each of the plurality of second channels terminating in a second nozzle, each second nozzle being larger than each first nozzle.

In another aspect of the present invention, the flow features can include a first channel in fluid communication with an ink reservoir and having a first length, a second channel in fluid communication with the ink reservoir and having a second length greater than the first length, a first nozzle in fluid communication with the first channel and having a first cross-sectional area, and a second nozzle in fluid communication with the second channel and having a second cross-sectional area greater than the first cross-sectional area.

Another aspect of the present invention provides a method for producing varying ink drop-volumes using an inkjet printhead. The method can include providing a housing defining an ink reservoir containing ink, providing a nozzle plate coupled to the housing, defining a first channel in the nozzle plate in fluid communication with the ink reservoir, the first channel having a first length and terminating in a first nozzle, and defining a second channel in the nozzle plate in fluid communication with the ink reservoir, the second channel having a second length greater than the first length and terminating in a second nozzle, the second nozzle being larger than the first nozzle.

Other features and aspects of the invention will become apparent to those skilled in the art upon review of the following detailed description, claims and drawings.

Figure 2:
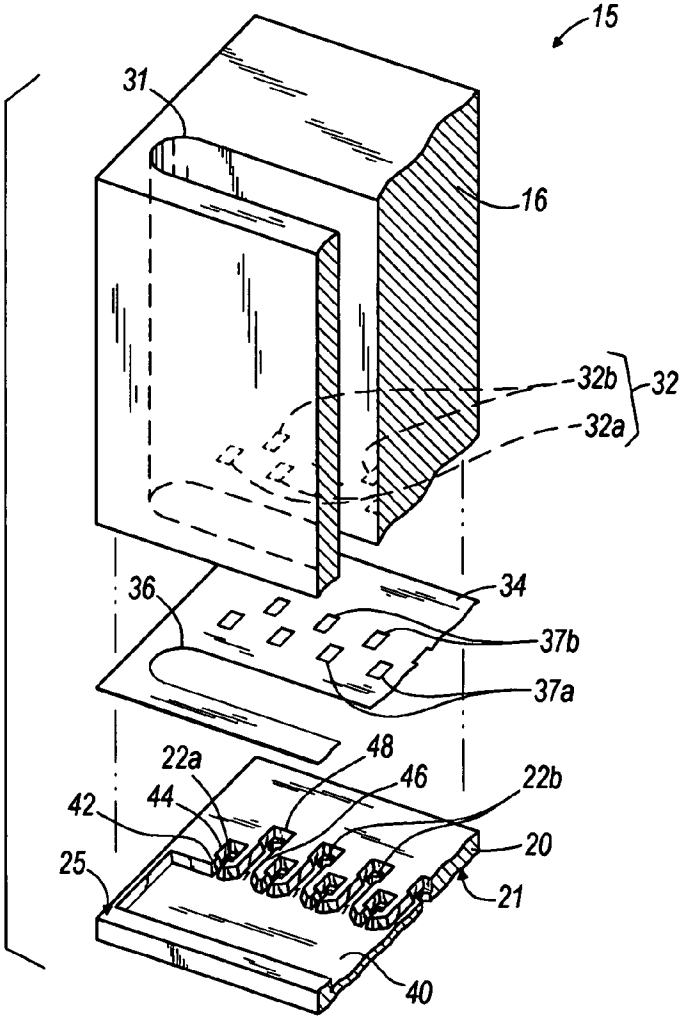
FIG. 2 is a partial exploded view of the nozzle portion of the printhead of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or coupling, and can include electrical connections or couplings, whether direct or indirect.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and other alternative mechanical configurations are possible.

DETAILED DESCRIPTION

The present invention generally relates to a printhead having a nozzle portion used to produce multiple print drop-volumes for printing in a variety of modes, including without limitation, draft mode, high-quality mode and a combination thereof.

As used herein and in the appended claims, the term "ink" can refer to at least one of inks, dyes, stains, pigments, colorants, tints, a combination thereof, and any other material commonly used for inkjet printers.

As used herein and in the appended claims, the term "printing medium" can refer to at least one of paper (including without limitation stock paper, stationary, tissue paper, homemade paper, and the like), film, tape, photo paper, a combination thereof, and any other medium commonly used in inkjet printers.

Figure 1:
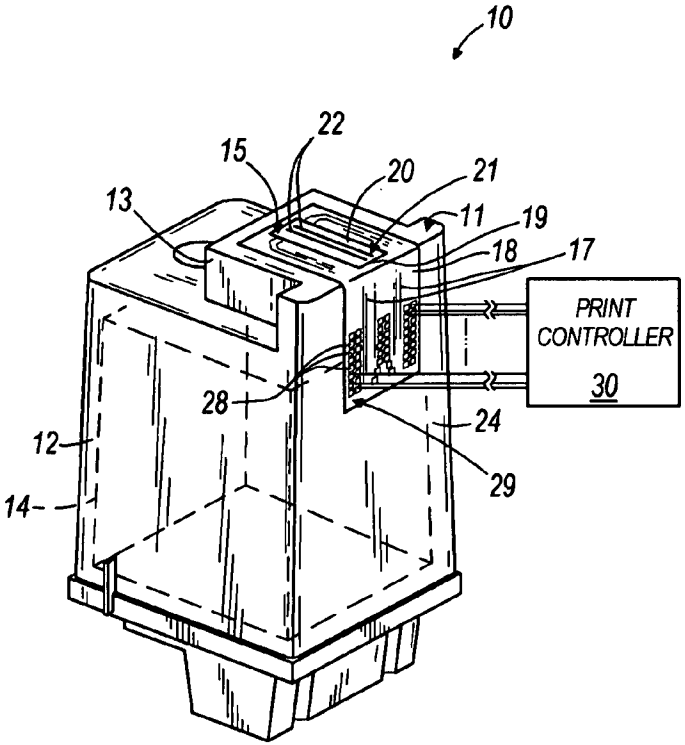
FIG. 1 is an isometric view of an inkjet printhead according to one embodiment of the present invention having a nozzle portion.

FIG. 1 illustrates an inkjet printhead 10 according to one embodiment of the present invention. The printhead 10 includes a housing 12 that defines a nosepiece 13 and an ink reservoir 14 containing ink or, for example, a foam insert saturated with ink. In other embodiments, an ink reservoir can be provided that is separate from the printhead, but in fluid communication therewith. The housing 12 can be constructed of a variety of materials including, without limitation, at least one of polymers, metals, ceramics, composites, etc.

The inkjet printhead 10 illustrated in FIG. 1 has been inverted to illustrate a nozzle portion 15 of the printhead 10. In the illustrated embodiment, the nozzle portion 15 is located at least partially on a bottom surface 11 of the nosepiece 13 for transferring ink from the ink reservoir 14 onto a printing medium. The nozzle portion 15 can include a chip or member 16 (not visible in FIG. 1) and a nozzle plate 20 having a plurality of nozzles 22 that define a nozzle arrangement and from which ink drops are ejected onto printing medium that is advanced through a printer (not shown). The nozzles 22 can have any cross-sectional shape desired including, without limitation, circular, elliptical, square, rectangular, and any other polygonal shape that allows ink to be transferred from the printhead 10 to a printing medium.

The chip 16 can be formed of a variety of materials including, without limitation, various forms of doped or non-doped silicon, doped or non-doped germanium, or any other semiconducting material. The chip 16 is positioned to be in electrical communication with conductive traces 17 provided on an underside of a tape member 18. The chip 16 is hidden from view in the assembled printhead 10 illustrated in FIG. 1 and is attached to the nozzle plate 20 in a removed area or cutout portion 19 of the tape member 18 such that an outwardly facing surface 21 of the nozzle plate 20 is generally flush with and parallel to an outer surface 29 of the tape member 18 for directing ink onto a printing medium via the plurality of nozzles 22 in fluid communication with the ink reservoir 14.

The tape member 18 is coupled to one side 24 of the housing 12 and most of the bottom surface 11 of the nosepiece 13. The tape member 18 can be constructed of a thin, flexible material (e.g., polyimide). In some embodiments of the present invention, the tape member 18 can be a TAB circuit, wherein the acronym "TAB" stands for Tape (or Thermal) Automated Bonding. TAB is a procedure for interconnecting a chip, such as the chip 16 of the illustrated embodiment, to a leadframe in which the interconnections, or conductive traces 17, are patterned on a multilayer polymer tape. The TAB circuit can then be positioned so that the conductive traces 17 correspond to bonding sites on the chip.

The conductive traces 17 can be provided on the tape member 18 by a variety of methods, including without limitation, plating processes, photolithographic etching, and any other method known to those of ordinary skill in the art. Each conductive trace 17 connects, directly or indirectly, at one end to a heat transducer 32 of the chip 16 and terminates at an opposite end at a contact pad 28. Each contact pad 28 extends through to the outer surface 29 of the tape member 18. The contact pads 28 are positioned to mate with corresponding contacts on a carriage (not shown) to communicate between a microprocessor-based printer controller 30 and components of the printhead 10, particularly, the heat transducers 32, as will be described in greater detail below. The tape member 18 can be formed of a variety of other polymers or materials capable of providing conductive traces 17 to electrically connect the nozzle portion 15 of the printhead 10 to the contact pads 28 and the printer controller 30.

FIG. 2 illustrates an exploded view of the nozzle portion 15 of the printhead 10. The nozzle portion 15 includes the chip 16 having an aperture 31 and a plurality of heat transducers 32 (particularly, a plurality of first heat transducers 32*a* and a plurality of second heat transducers 32*b*), a film 34, and the nozzle plate 20.

The film 34 is positioned to protect circuitry of the chip 16 (i.e., components on the chip 16 necessary to maintain electrical connection between the heat transducers 32 and the printer controller 30) from corrosive properties of the ink. The film 34 includes an aperture 36 that corresponds with the aperture 31 of the chip 16. The film 34 further includes a plurality of apertures 37 (particularly, a plurality of first apertures 37*a* and a plurality of second apertures 37*b* that correspond with the plurality of first heat transducers 32*a* and the plurality of second heat transducers 32*b*, respectively). The chip 16 and the film 34 are coupled to the housing 12 such that the apertures 31 and 36 collectively define an ink via and fluidly communicate with the ink reservoir 14.

The film 34 can be constructed of a variety of materials (e.g., epoxy photoresist, otherwise referred to as a photocurable epoxy resin) that are substantially impermeable to the ink. In some embodiments of the present invention, the film 34 is initially in a liquid state and is applied to a surface of the chip 16 to be exposed to the ink. The liquid can then be spun (e.g., using a centrifuge) to create a film 34 of uniform thickness, and then exposed, developed and cured (e.g., using elevated temperatures) as known in the art to define the apertures 37*a* and 37*b*. The apertures 31 and 36 can then be formed (e.g., simultaneously or sequentially) through the chip 16 and the film 34, respectively, by a variety of processes including various types of sandblasting processes or other processes known to those of ordinary skill in the art. In other embodiments, the film 34 can be formed of a solid material, in which the apertures 36 and 37*a, b* are formed, that is coupled to the chip 16 in a way to align the aperture 31 with the aperture 36. Other materials or layers of materials known in the art may be applied to the chip 16 to protect any components of the chip 16 that may be sensitive to the corrosive properties of the ink, and these are included within the spirit and scope of the present invention.

Figure 3:
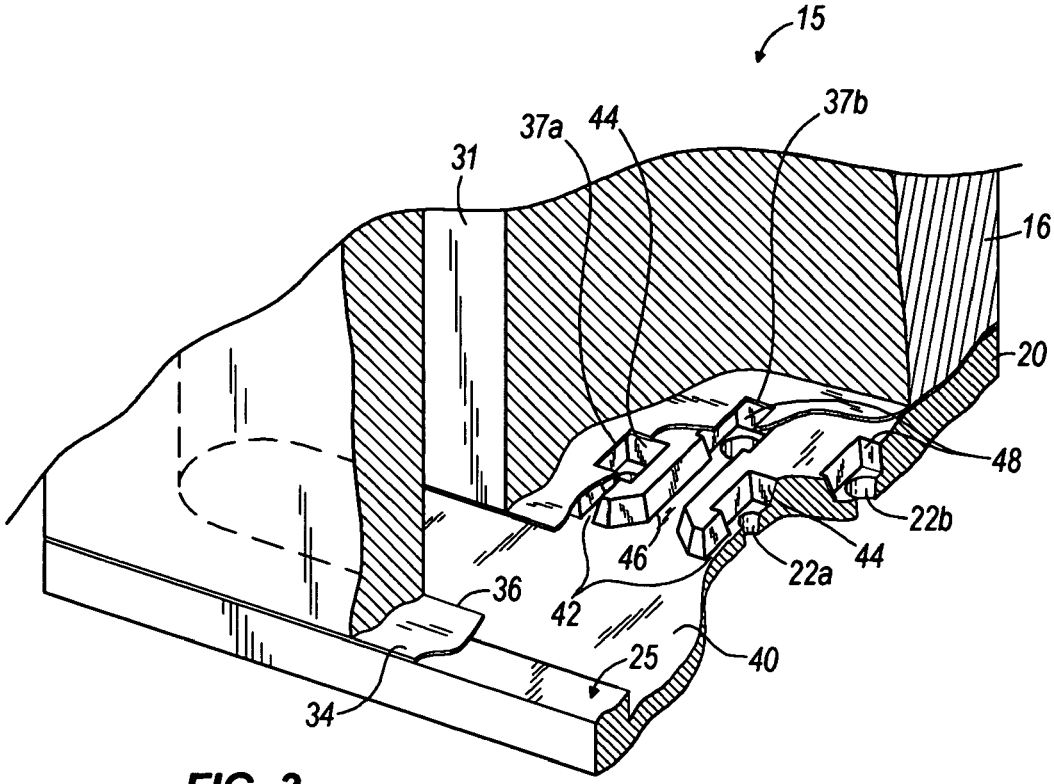
FIG. 3 is a partial isometric view of the nozzle portion of the printhead of FIG. 1.

With continued reference to FIG. 2, the nozzle plate 20 includes a recess 40, which fluidly communicates with the ink reservoir 14 via the apertures 31 and 36 of chip 16 and the film 34, respectively. As best shown in FIG. 3, the recess 40 of the illustrated embodiment is wider than the apertures 31 and 36 to substantially prevent spilling of the ink or leaking of the ink in between adjacent layers of the nozzle portion 15. The nozzle plate 20 further includes a plurality of first channels 42, each first channel 42 extending to a first chamber 44 and terminating in a first nozzle 22*a* (also referred to as a "near nozzle"). The nozzle plate 20 also includes a plurality of second channels 46, each second channel 46 extending to a second chamber 48 and terminating in a second nozzle 22*b* (also referred to as a "far nozzle"). Any portion of at least one of the recess 40, the first and second channels 42 and 46, the first and second chambers 44 and 48, and the first and second nozzles 22*a* and 22*b* can be collectively referred to as "flow features."

Figure 4:
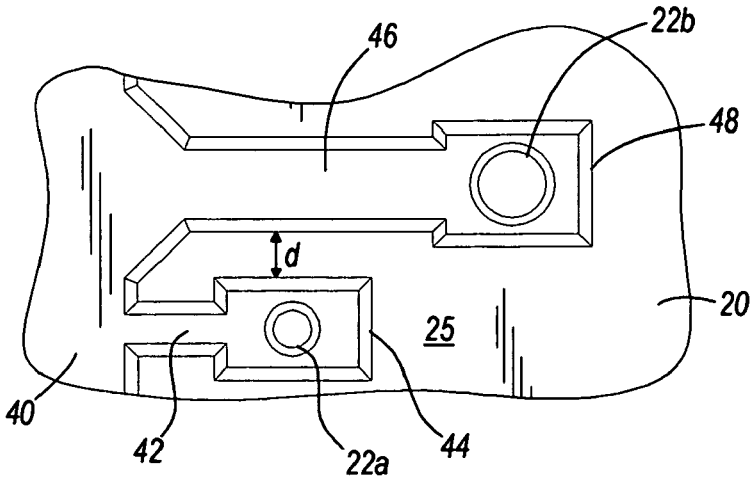
FIG. 4 is a close-up plan view of the nozzle portion of FIGS. 2 and 3.

In some embodiments, flow features can be defined in a layer(s) or substrate(s), including those distinct from a nozzle plate. For example, flow features can be defined in a thick film layer, such as through methods that include, without limitation, at least one of laser ablation, vapor deposition, lithography, plasma etching, metal electrodeposition, and a combination thereof. In other embodiments, as illustrated in FIGS. 2–4, the flow features can be defined in a nozzle plate, such as nozzle plate 20. In addition, the flow features (or portions thereof) do not need to be defined in the same layer(s) or substrate(s), but rather, some of the flow features (e.g., the first and second channels 42 and 46 and the first and second chambers 44 and 48) can be defined in one or more first layers or substrates, and other flow features (e.g., the nozzles 22*a* and 22*b*) can be defined in a second layer or substrate, such as nozzle plate 20. Furthermore, flow features do not need to be defined in the same materials, and the method(s) used to define flow features in one layer or material do not need to be same method(s) used to define flow features in the other layers(s) or material(s). For example, flow features can be defined in one or more thin or thick film layers, such as by methods including at least one of lithography, vapor deposition and plasma etching, and the nozzle plate 20 can include one or more layers of polyimide having flow features defined by laser ablation.

By way of example only, the nozzle plate 20 of the illustrated embodiment has one set of near nozzles (i.e., the first nozzles 22*a*), and one set of far nozzles (i.e., the second nozzles 22*b*). However, any number of sets of nozzles positioned at varying distances from the recess 40 can be used without departing from the spirit and scope of the present invention.

Ink can travel (e.g., by gravity and/or capillary action) from the ink reservoir 14 (e.g., in the housing 12) through the apertures 31 and 36, into the recess 40, into the plurality of first channels 42 and second channels 46, and into the plurality of first chambers 44 and second chambers 48.

Heat transducer 32*a* and heat transducer 32*b* are positioned on an underside of the chip 16 adjacent the first chambers 44 and the second chambers 48, respectively. Heat transducers 32*a* and 32*b* can include any transducer capable of converting electrical energy into heat, such as a resistor, and particularly, a thin-film resistor. Electrical signals are sent from the printer controller 30 to the heat transducers 32*a* and/or 32*b* via the conductive traces 17 of the tape member 18 to heat the heat transducer 32*a* and/or the heat transducer 32*b* and vaporize the ink in the first chambers 44 and/or the second chambers 48, respectively, depending on the mode of printing that has been selected, which will be described in greater detail below.

The amount of ink ejected from each of the first chambers 44 or each of the second chambers 48 is related to the size of the heat transducers 32*a* and 32*b* and/or the size and shape of the corresponding nozzle 22*a* or 22*b*. Surface tension and viscosity of the ink, along with the relatively small size of the nozzles 22 and the pressure established by the ink reservoir 14 (further discussion of which is outside the scope of the present invention), inhibit the ink from spilling out of the nozzle(s) 22*a* and/or 22*b* until the corresponding heat transducer(s) 32*a* and/or 32*b*, respectively, is (are) actuated.

Apertures 37*a* and 37*b* in the film 34 expose the heat transducers 32*a* and 32*b* to the first chambers 44 and the second chambers 48, respectively. As a result, when one or more electrical signals are sent from the printer controller 30 to actuate (e.g., heat) a heat transducer 32*a*, the heat transducer 32*a* heats a thin layer of ink in the adjacent first chamber 44, thereby vaporizing a volatile component of the ink and ejecting a portion of the ink occupying the first chamber 44 out of the adjacent first nozzle 22*a* in the form of an ink droplet (or drop), which can strike a desired location of a printing medium. The first chamber 44 subsequently refills with ink (e.g., by capillary action) in order to prime the first chamber 44 for subsequent printing.

FIG. 3 illustrates the nozzle portion 15 of FIG. 2 as assembled, with portions removed to reveal the flow features (which, in the illustrated embodiment, are in nozzle plate 20). A first nozzle 22*a* and a second nozzle 22*b* are shown in partial view to illustrate the relative sizes of the first and second nozzles 22*a* and 22*b*, which will be described in greater detail below. The nozzle plate 20, and particularly a surface 25 of the nozzle plate 20, can be coupled to the film 34 and/or the chip 16 with an adhesive. In some embodiments of the present invention, the adhesive can be integrally formed with a remainder of the nozzle plate 20 (i.e., the one or more layers of the nozzle plate 20 described above) in the form of an adhesive layer. The adhesive layer can be formed of a variety of materials including, without limitation, at least one of phenolic resins, resorcinol resins, urea resins, epoxy resins, ethylene-urea resins, furane resins, polyurethane resins, silicon resins, combinations thereof and any other adhesive known to those of ordinary skill in the art. The adhesive layer can have a thickness ranging from about 1 $\mu$m to about 40 $\mu$m, and particularly, ranging from about 1 $\mu$m to about 25 $\mu$m. In other embodiments, an adhesive can be sprayed, brushed or applied in any other manner known in the art to at least one of the nozzle plate 20, the film 34, and the chip 16.

The nozzle plate 20 (i.e., the one or more layers described above) can be formed of a variety of materials including, without limitation, at least one of a polyimide, a metal, a ceramic, and a combination thereof. The thickness of the nozzle plate 20 can range from about 1 μm to about 200 μm, particularly, from about 10 μm to about 80 μm, and more particularly, from about 15 μm to about 40 μm.

The nozzle plate 20 of the illustrated embodiment is formed of polyimide, and the flow features of the nozzle plate 20 have been laser-ablated. Laser-ablating the flow features of the nozzle plate 20 creates ablation angles (not necessarily all equal) in the sidewalls of the recess 40, the first and second channels 42 and 46, the first and second chambers 44 and 48, and the first and second nozzles 22*a* and 22*b*. The ablation angles in the sidewalls of the flow features of the illustrated embodiment are best illustrated in FIG. 3, which shows that the flow features are slightly wider at the open portion adjacent the film 34 or the chip 16 (i.e., referred to herein as the "base dimension") than at the opposite end. The ablation angles can be predicted given various parameters of the laser ablation process, such as the wavelength of the ablating laser, the power of the ablating laser, the distance between the nozzle plate 20 and the ablating laser, the desired depth of ablation, the length of time the ablating laser is directed toward the nozzle plate 20, etc. By way of example only, the ablation angles in the sidewalls of the recess 40, the first and second channels 42 and 46, the first and second chambers 44 and 48, and the first and second nozzles 22*a* and 22*b* can be greater than approximately 2°, less than 25°, and more particularly greater than 5° and less than 20°.

FIG. 4 illustrates a close-up top view of two adjacent nozzles 22 of the nozzle plate 20, namely, a first nozzle 22*a* and a second nozzle 22*b*. It should be noted that the first nozzle 22*a* and the second nozzle 22*b* in FIG. 4 are meant to represent a plurality of first nozzles 22*a* and a plurality of second nozzles 22*b*, respectively, but are shown individually in FIG. 4 for clarity.

As illustrated in FIG. 4, the first nozzle 22*a* is located at a position closer to the recess 40, i.e., the "near position," and the second nozzle 22*b* is located at a position further from the recess 40, i.e., the "far position." Said another way, the first channel 42 is shorter in length (i.e., in a direction parallel to ink flow in the channel) than the second channel 46. By way of example only, the first channel 42 can have a length (i.e., in a direction generally parallel to the direction of ink flow in the first channel 42) of 14 μm±5 μm, particularly, 14 μm±2 μm, and more particularly, 14 μm±1 μm. By way of further example, the second channel 46 can have a length (i.e., in a direction generally parallel to the direction of ink flow in the second channel 46) of 69.5 μm±5 μm in length, particularly, 69.5 μm±2 μm, and more particularly, 69.5 μm±1 μM. Furthermore, the plurality of first and second channels 42 and 46 do not all need to have the same length, but rather can have varying lengths to achieve a closer-packed fit of the first and second chambers 44 and 48 and the respective heat transducers 32*a* and 32*b*, and to accommodate any heat transducer 32/nozzle 22 stagger associated with heat transducer 32/nozzle 22 fire order. For ablated flow features that include ablation angles, the above dimensions represent the base dimensions of the flow features.

The first nozzle 22*a* has a smaller cross-sectional diameter than that of the second nozzle 22*b* (see also FIG. 3). In other words, the first nozzle 22*a* has a smaller cross-sectional area than that of the second nozzle 22*b*. In other embodiments of the present invention in which the nozzles do not have circular cross-sections, the first nozzle 22*a* has a smaller cross-sectional dimension than that of the second nozzle 22*b*. By way of example only, in embodiments wherein the first nozzle 22*a* has a circular cross-section, the first nozzle 22*a* can have an entrance diameter (i.e., the diameter of the first nozzle 22*a* adjacent the first chamber 44) of 16 μm±5 μm, particularly, 16 μm±2 μm, and more particularly, 16 μm±1 μm. An exemplary first nozzle 22*a* can have an exit diameter (i.e., the diameter of the first nozzle 22*a* adjacent the outwardly facing surface 21 of the nozzle plate 20) of 11 μm±5 μm, particularly, 11 μm±2 μm, and more particularly, 11 μm±1 μm. An exit diameter of 11 μm±1 μm produces a 3 ng±1 ng drop of ink. By way of further example, in embodiments wherein the second nozzle 22*b* has a circular cross-section, the second nozzle 22*b* can have an entrance diameter of 24.5 μm±5 μm, particularly, 24.5 μm±2 μm, and more particularly, 24.5 μm±1 μm. An exemplary second nozzle 22*b* can have an exit diameter of 19.5 μm±5 μm, particularly, 19.5 μm±2 μm, and more particularly, 19.5 μm±1 μm. An exit diameter of 19.5 μm±1 μm produces a 10 ng±1 ng drop of ink.

When a high-quality mode of printing is selected, electrical signals from the printer controller 30 can actuate the heat transducers 32*a* (see FIG. 2) adjacent the first chambers 44 to heat the ink in the first chambers 44 and eject the ink from the first (smaller) nozzles 22*a*. Alternatively, when a draft or low-quality mode of printing is selected, electrical signals from the printer controller 30 can actuate the heat transducers 32*b* adjacent the second chambers 48 to heat the ink in the second chambers 48 and eject the ink from the second (larger) nozzles 22*b*. In addition, when an intermediate or combination mode of printing is selected, at least some of both of the heat transducers 32*a* and 32*b* can be actuated to heat the ink in at least some of both of the first and second chambers 44 and 48 and eject the ink from at least some of both of the first and second nozzles 22*a* and 22*b*. By way of example only, the printhead 10 of the illustrated embodiment can produce a vertical print resolution of 600 dots-per-inch (dpi).

In addition, the first channel 42 is narrower than the second channel 46 in order to provide greater damping in the first channel 42 to ink waves during refill. Damping the amplitude of the ink waves flowing to a chamber and the adjacent nozzle minimizes meniscus oscillation within the nozzle. Meniscus oscillation within a nozzle can at least partly contribute to flooding from that nozzle. By way of example only, the first channel 42 can have a width (i.e., in a direction generally perpendicular to the direction of ink flow in the first channel 42) of 10 μm±5 μm, particularly, 10 μm±2 μm, and more particularly, 10 μm±1 μm. By way of further example, the second channel 46 can have a width (i.e., in a direction generally perpendicular to the direction of ink flow in the second channel 46) of 28 μm±5 μm, particularly, 28 μm±2 μm, and more particularly, 28 μm±1 μm. For ablated flow features that include ablation angles, the above dimensions represent the portion of the flow features adjacent the chip 16 and/or the film 34.

By arranging the nozzles 22 such that the smaller nozzle is at the near position, the smaller nozzle 22*a* (the first nozzle 22*a*) is paired with the smaller channel 42 (the first channel 42), and the larger nozzle 22*b* (the second nozzle 22*b*) is paired with the larger channel 46 (the second channel 46). As mentioned above, smaller nozzles are more susceptible to flooding than larger nozzles. Flooding of ink from the smaller nozzle 22*a* can be reduced by placing the smaller nozzle 22*a* in fluid communication with the more highly-damped smaller channel 42.

Thus, one embodiment of the present invention pairs the smaller nozzle 22*a* with the smaller channel 42 such that particles that may clog the smaller nozzle 22*a* are not permitted to enter the smaller channel 42 that leads to the smaller nozzle 22*a*. In addition, if larger particles are permitted to pass through the larger channel 46, the particles are much less likely to cause clogging of the larger nozzle 22*b*.

The first chamber 44 and the second chamber 48 are sized to accommodate the first nozzle 22*a* and the second nozzle 22*b*, respectively. As a result, because the first nozzle 22*a* is smaller than in previous designs, the first chamber 44 can accordingly be smaller (i.e., have a smaller cross-sectional area in the plane of FIG. 4) than in previous designs. Decreasing the cross-sectional area of the first chamber 44 (or simply decreasing the width of the first chamber 44) increases the distance d between the first chamber 44 and the second channel 46, which in turn increases the total surface area of the surface 25 of the nozzle plate 20. Increasing the total surface area of the surface 25 increases the integrity of the coupling between at least one of the nozzle plate 20, the film 34 and the chip 16. For example, if the nozzle plate 20 includes an adhesive layer as mentioned above, increasing the distance d would increase the strength of adhesion between at least one of the adhesive layer of the nozzle plate 20, the film 34 and the chip 16, as well as reduce the likelihood of nozzle plate delamination.

By way of example only, the first chamber 44 can have a length of 40 $\mu$m±5 $\mu$m, particularly, 40 $\mu$m±2 $\mu$m, and more particularly, 40 $\mu$m±1 $\mu$m. An exemplary first chamber 44 can have a width of 30 $\mu$m±5 $\mu$m, particularly, 30 $\mu$m±2 $\mu$m, and more particularly, 30 $\mu$m±1 $\mu$m. By way of further example, the second chamber 48 can have a length of 46 $\mu$m±5 $\mu$m, particularly, 46 $\mu$m±2 $\mu$m, and more particularly, 46 $\mu$m±1 $\mu$m. An exemplary second chamber 48 can have a width of 37 $\mu$m±5 $\mu$m, particularly, 37 $\mu$m±2 $\mu$m, and more particularly, 37 $\mu$m±2 $\mu$m. For ablated flow features that include ablation angles, the above dimensions represent the portion of the flow features adjacent the chip 16 and/or the film 34.

Various features and aspects of the invention are set forth in the following claims.

We claim:

1. Flow features in an inkjet printhead, the flow features comprising:

a plurality of first channels, each of the plurality of first channels having a first length and positioned to fluidly communicate with an ink reservoir, and each of the plurality of first channels terminating in a first nozzle from which ink is ejected during at least one mode of printing; and a plurality of second channels, each of the plurality of second channels having a second length greater than the first length and positioned to fluidly communicate with the ink reservoir, each of the plurality of second channels terminating in a second nozzle from which ink is ejected during at least one mode of printing, each second nozzle being larger than each first nozzle.

2. The flow features set forth in claim 1, wherein the first channels, the first nozzles, the second channels and the second nozzles are defined in a nozzle plate by laser ablation.

3. The flow features set forth in claim 2, wherein the nozzle plate is constructed of at least one of polyimide and phenolic.

4. The flow features set forth in claim 2, further comprising a recess defined in the nozzle plate and in fluid communication with the ink reservoir, the recess having an axial direction.

5. The flow features set forth in claim 4, wherein each of the plurality of first channels and each of the plurality of second channels comprise an axial direction generally perpendicular to the axial direction of the recess.

6. The flow features set forth in claim 1, wherein the first nozzles and the second nozzles are defined in a nozzle plate, and the first channels and the second channels are defined in a layer distinct from the nozzle plate.

7. The flow features set forth in claim 1, further comprising:

a plurality of first chambers, each first chamber positioned in fluid communication with a first channel and a first nozzle; and a plurality of second chambers, each second chamber positioned in fluid communication with a second channel and a second nozzle.

8. The flow features set forth in claim 7, wherein the first nozzles and the second nozzles are defined in a nozzle plate, and the first channels, the first chambers, the second channels and the second chambers are defined in a layer distinct from the nozzle plate.

9. The flow features set forth in claim 7, wherein each of the first chambers is separated from each of the second channels by a first distance, and wherein each of the first chambers is sized to maximize the first distance.

10. The flow features set forth in claim 1, wherein each first nozzle is used to produce a smaller ink drop-volume than that of each second nozzle.

11. The flow features set forth in claim 1, wherein each of the first channels have a cross-sectional dimension no greater than a cross-sectional dimension of each of the first nozzles.

12. The flow features set forth in claim 1, wherein each first nozzle produces higher resolution printing than each second nozzle.

13. The flow features set forth in claim 1, wherein each second nozzle is sized to inhibit flooding of ink from each second nozzle.

14. The flow features set forth in claim 1, wherein each of the first channels is sized to damp the ink as it flows in each of the first channels to reduce flooding from each first nozzle.

15. Flow features in an inkjet printhead, the flow features comprising:

a first channel in fluid communication with an ink reservoir and having a first length;

a second channel in fluid communication with the ink reservoir and having a second length greater than the first length;

a first nozzle from which ink is ejected in at least one printing mode, the first nozzle in fluid communication with the first channel and having a first cross-sectional area; and a second nozzle from which ink is ejected in at least one printing mode, the second nozzle in fluid communication with the second channel and having a second cross-sectional area greater than the first cross-sectional area.

16. The flow features set forth in claim 15, wherein the ink reservoir is defined in a housing of the printhead, the first nozzle is positioned adjacent an end of the first channel opposite the ink reservoir, and wherein the second nozzle is positioned adjacent an end of the second channel opposite the ink reservoir.

17. The flow features set forth in claim 15, wherein the first nozzle and the second nozzle are defined in a nozzle plate, and the first channel and the second channel are defined in a layer distinct from the nozzle plate.

18. The flow features set forth in claim 15, wherein the first channel, the first nozzle, the second channel and the second nozzle are formed in the nozzle plate by laser ablation.

19. The flow features set forth in claim 18, wherein the nozzle plate is constructed of at least one of polyimide and phenolic.

20. The flow features set forth in claim 15, wherein the flow features further comprise:

a first chamber positioned between the first channel and the first nozzle and in fluid communication with the first channel and the first nozzle, and a second chamber positioned between the second channel and the second nozzle and in fluid communication with the second channel and the second nozzle.

21. The flow features set forth in claim 20, wherein the inkjet printhead further comprises a chip having a first heat transducer and a second heat transducer, the chip positioned adjacent a nozzle plate, in which the flow features are defined, such that the first heat transducer is positioned adjacent the first chamber to heat the ink in the first chamber, and such that the second heat transducer is positioned adjacent the second chamber to heat the ink in the second chamber.

22. The flow features set forth in claim 21, wherein the inkjet printhead further comprises a film positioned between the chip and the nozzle plate to protect the chip from the ink.

23. The flow features set forth in claim 20, wherein the first chamber is separated from the second channel by a first distance, and wherein the first chamber is sized to maximize the first distance.

24. The flow features set forth in claim 20, wherein the first nozzle and the second nozzle are defined in a nozzle plate, and the first channel, the first chamber, the second channel and the second chamber are defined in a layer distinct from the nozzle plate.

25. The flow features set forth in claim 15, wherein the first channel is one of a plurality of first channels, the second channel is one of a plurality of second channels, the first nozzle is one of a plurality of first nozzles, and the second nozzle is one of a plurality of second nozzles.

26. The flow features set forth in claim 15, wherein the first nozzle produces ink drops having a smaller volume than ink drops produced by the second nozzle.

27. The flow features set forth in claim 15, wherein the first channel is sized to damp the ink as it flows in the first channel to reduce flooding from the first nozzle.

28. The flow features set forth in claim 15, wherein the inkjet printhead is used to create at least one of a high-quality print and a draft-mode print.

29. The flow features set forth in claim 15, wherein the first channel is sized to inhibit particles of the ink having a dimension larger than a cross-sectional dimension of the first nozzle from entering the first channel.

30. The flow features set forth in claim 15, wherein the second nozzle is sized to inhibit the ink from flooding out of the second nozzle.

31. A method for producing various ink drop-volumes using an inkjet printhead, the method comprising:

providing a housing defining an ink reservoir containing ink;

providing a nozzle plate coupled to the housing;

defining a first channel in the nozzle plate in fluid communication with the ink reservoir, the first channel having a first length;

defining a first nozzle in the nozzle plate in fluid communication with the first channel;

defining a second channel in the nozzle plate in fluid communication with the ink reservoir, the second channel having a second length greater than the first length;

defining a second nozzle in the nozzle plate in fluid communication with the second channel, the second nozzle being larger than the first nozzle;

ejecting ink from the first nozzle during at least one mode of printing; and ejecting ink from the second nozzle during at least one mode of printing.

32. The method set forth in claim 31, further comprising:

providing a first chamber in fluid communication with the first channel and the first nozzle, the first chamber separated from the second channel by a first distance; and dimensioning the first chamber to maximize the first distance.

33. The method set forth in claim 31, further comprising damping the ink flowing in the first channel more than ink flowing in the second channel.

34. The method set forth in claim 31, further comprising dimensioning the first channel to have a cross-sectional dimension no greater than a cross-sectional dimension of the first nozzle to inhibit particles of the ink from clogging the first nozzle.

35. The method set forth in claim 31, wherein the first channel has a smaller cross-sectional area than that of the second channel, wherein the first nozzle is in fluid communication with the first channel to inhibit clogging of the first nozzle; and wherein the second nozzle is in fluid communication with the second channel to inhibit ink from flooding out of the second nozzle.

36. The method set forth in claim 31, further comprising producing ink drops with the first nozzle having a smaller volume than ink drops produced by the second nozzle.

37. The method set forth in claim 31, wherein defining a first channel and defining a second channel include laser ablating the nozzle plate.

* * * * *